US010104936B2

(12) United States Patent
Mulholland

(10) Patent No.: US 10,104,936 B2
(45) Date of Patent: Oct. 23, 2018

(54) SHOE WITH INTERCHANGEABLE SOLE

(71) Applicant: McCauley LLC, Lexington, KY (US)

(72) Inventor: Sarah Melissa Mulholland, Lexington, KY (US)

( * ) Notice: Subject to any disclaimer, the term of this patent is extended or adjusted under 35 U.S.C. 154(b) by 0 days.

(21) Appl. No.: 15/422,901

(22) Filed: Feb. 2, 2017

(65) Prior Publication Data

US 2018/0103721 A1 Apr. 19, 2018

Related U.S. Application Data

(60) Provisional application No. 62/409,069, filed on Oct. 17, 2016.

(51) Int. Cl.

| | |
|---|---|
| ***A43B 13/36*** | (2006.01) |
| ***A43B 13/14*** | (2006.01) |
| ***A43B 3/24*** | (2006.01) |
| ***A43C 15/16*** | (2006.01) |
| ***A43B 5/00*** | (2006.01) |
| ***A43B 5/16*** | (2006.01) |
| ***A63C 17/20*** | (2006.01) |

(52) U.S. Cl.

CPC ..... *A43B 13/36* (2013.01); *A43B 3/244* (2013.01); *A43B 5/001* (2013.01); *A43B 5/1641* (2013.01); *A43B 13/141* (2013.01); *A43C 15/16* (2013.01); *A63C 17/20* (2013.01)

(58) Field of Classification Search

CPC ..... A43B 13/36; A43B 3/244
USPC ..... 36/15, 100
See application file for complete search history.

(56) References Cited

U.S. PATENT DOCUMENTS

| | | | | |
|---|---|---|---|---|
| 631,821 | A * | 8/1899 | Riemer | A43B 13/08 36/101 |
| 2,677,905 | A * | 5/1954 | Dye | A43C 13/04 36/128 |
| 3,138,880 | A * | 6/1964 | Kunzli | A43B 5/02 36/105 |
| 3,758,891 | A | 9/1973 | Geister | |
| 3,902,259 | A | 9/1975 | Cracco | |
| D243,976 | S * | 4/1977 | Dassler | D2/906 |
| 4,176,459 | A | 12/1979 | Perser et al. | |

(Continued)

FOREIGN PATENT DOCUMENTS

WO WO2011014146 A1 2/2011

OTHER PUBLICATIONS

PCT International Search Report, Int. App. No. PCT/US17/22750.

*Primary Examiner* — Ted Kavanaugh
(74) *Attorney, Agent, or Firm* — Michael Coblenz

(57) ABSTRACT

The convertible shoe with interchangeable sole consists of an upper to hold the foot and an interchangeable outsole. There is an attachment surface on the underside of the upper and an attachment surface on the topside of the outsole, and the two attachment surfaces are paired and configured to securely attach the two components while also being detachable to allow for the interchange of different outsoles having different tread surfaces. The attachment surfaces are a non-flat contoured shape. There are two protruding ridges on one surface, one substantially under the toe and the other under the heel and part of the arch. These mate with a recessed channel on the other surface. There is also attachment material on both surfaces that are mated and provide a secure attachment.

13 Claims, 5 Drawing Sheets

(56) References Cited

U.S. PATENT DOCUMENTS

| | | | | |
|---|---|---|---|---|
| 4,267,650 | A * | 5/1981 | Bauer | A43B 13/36 36/101 |
| D264,393 | S * | 5/1982 | Sasaki | D2/906 |
| 5,317,822 | A | 6/1994 | Johnson | |
| 7,111,416 | B2 | 9/2006 | Gallegos | |
| 7,246,453 | B2 | 7/2007 | Kim | |
| 7,549,237 | B2 | 6/2009 | Gallegos | |
| 7,752,695 | B2 | 7/2010 | Kaufman et al. | |
| 7,877,902 | B2 | 2/2011 | Pieriboni | |
| 7,984,569 | B2 | 7/2011 | Chaney et al. | |
| 8,307,571 | B1 | 11/2012 | Ceylan | |
| 2003/0033730 | A1* | 2/2003 | Burke | A43B 7/142 36/25 R |
| 2003/0200675 | A1 | 10/2003 | Gross | |
| 2006/0021260 | A1* | 2/2006 | Kim | A43B 5/00 36/130 |
| 2009/0193684 | A1 | 8/2009 | Diamond | |
| 2015/0020414 | A1* | 1/2015 | Mulholland | A43B 1/0081 36/100 |

* cited by examiner

SHOE WITH INTERCHANGEABLE SOLE

CROSS REFERENCE TO RELATED APPLICATIONS

This application claims priority to Provisional Application No. 62/409,069,filed on Oct. 17, 2016,and incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to footwear with removable and replaceable tread or sole to convert the shoe from one style or configuration to another, for example to change from a dress or casual shoe to a golf shoe.

Description of the Related Art

There have been numerous attempts over the years to develop shoes with interchangeable soles, or with different components that can be added to change the configuration of the shoe from on type or style to another. These attempts go back to at least the 1980's. Many involve the use of Velcro® style hook and loop material to attach the various components. Some involve attempts to convert low heel shoes to high heel shoes, others involve interchangeable soles that convert just the tread of the shoe. For a variety of reasons none have proven successful, and to the best of applicant's knowledge, have not resulted in shoes commercially available on the market.

U.S. Patent Application Publication No. US2003/0200675 to Gross, published on Oct. 30, 2003, teaches a sandal or "flip-flop" style shoe with multiple inserts, or core modules, to adjust the height of the shoe. The core modules are all inherently flat and of uniform thickness so the overall height of the shoe is altered but not the height of the heel in relation to the toe. The core modules are positioned by a series of corresponding holes and insertable pins, and held together by mating hook and loop material. There is a perimeter lip on the top attachment surface and a corresponding perimeter recess on the lower surface to help align the components. The lip is located on the perimeter of the shoe components and the recess cuts into the perimeter of the lower shoe component. The perimeter lip aligns with the recess in the perimeter, but is not inserted into the recess and does not lock the components into place.

U.S. Pat. No. 3,902,259, issued Sep. 2, 1975 to Cracco, discloses a sandal with interchangeable side plates and sole. The side plates and sole can be removed and replaced through a series of interlocking slots and the components are positioned with corresponding projections and holes. The side plates and sole can be altered to alter the look of the sandal, and in one embodiment a flat sole can be replaced with a sole with a wedge heel to convert the shoe from a low heel to a higher heel. Cracco does not disclose the use of an intermediate insertable component to alter a low heel into a high heel, and involves multiple components with a complicated locking mechanism.

U.S. Pat. No. 5,317,822 issued Jun. 7, 1994 to Johnson, is drawn to an athletic shoe with an interchangeable wear sole, or sole tread. The purpose is to allow the user to alter the tread to best match the tread to the surface of the athletic play area. The sole is positioned by an interlocking ridge and channel and by a series of knobs and knob chambers that correspond to align the components, and the sole is held in place by Velcro hook and loop material and a series of lock brackets with locking pins placed around the perimeter of the sole. Both the base of the upper and the interchangeable soles are flat, and the attachment surface between the upper and sole is flat.

U.S. Pat. No. 7,549,237 issued on Jun. 23, 2009 to Gallegos, discloses a shoe with a removable and interchangeable cushion and orthotic plate. The cushion and orthotic plate are positioned and held in place by corresponding studs and apertures, or in the alternative by hook and loop material such as Velcro. Gallegos does not alter the height of the heel or the tread on the sole.

U.S. Patent Application Publication No. US2009/0193684 to Diamond, published on Aug. 6, 2009, teaches a convertible shoe with removable and replaceable foot bed upper and sole portion with various height and style sole and heel portion. The components are aligned by a series of corresponding prongs and recesses, and held in place by corresponding hook and loop material such as Velcro, along with a series of snap like fasteners on the periphery of the outsole. Diamond discloses heels of differing heights and styles, but does use an insert placed between the insole and sole to alter the height of the shoe or the heel.

U.S. Pat. No. 7,246,453 to Kim, issued on Jul. 24, 2007, teaches a bowling shoe with interchangeable soles. Apparently some bowlers want one of their shoes to slide a bit more than the other, and this invention allows them to do this. The shoes consist of a separate depression in both the heel and the forefoot portion of the shoe. There is an alignment recess that runs roughly around the perimeter of the depression. The interchangeable sole plates have a coupling protrusion that fits into the alignment recess to properly align the sole plate into the depression.

The sole plate fits entirely into the depression, and its outside perimeter of the sole plate is also within the depression. Because of the nature of bowling shoes, the sole plates are flat to correspond to the flat surface of the bowling lane. Because of this the attachment surfaces within the recess are also flat.

U.S. Pat. No. 8,307,571 to Ceylan, discloses a ladies shoe that can be converted from a flat style shoe to a stiletto style high heel shoe. The bottom of the top shoe is flat to create the sole of the flat shoe. There are a series of flanged attachment plates on the underside of the top shoe. There is also a shoe base with a stiletto style high heel. The shoe base has a flat top attachment surface with a recessed lip that mates with the flanges of the attachment plates to hold the shoe base to the top shoe to create a high heeled show.

U.S. Pat. No. 7,984,569 to Chaney, issued on Jul. 26, 2011. (Note there are at least four other Chaney patents to various aspects of this technology, including U.S. Pat. Nos. 7,331,123, 7,520,069, and 8,544,189). Chaney is drawn to a shoe having interchangeable soles. The shoe upper has a recessed cavity on the bottom that is defined by a sidewall that runs the entire perimeter of the shoe, and an interchangeable sole unit that fits within the recessed cavity. There is hook and loop material inside the cavity that helps hold the sole unit in place, and a series of flaps which also help hold the sole unit within the recessed cavity.

These prior art patents show that inventors have been trying to create shoes with interchangeable soles since at least the early 1990's. None of these shoes are believed to be on the market. It is believed that the reason they are not commercially available is that the attachment and mating between the shoe upper and the interchangeable sole does not hold the components together.

SUMMARY OF THE INVENTION

The invention consists of a convertible shoe with an interchangeable sole. In the preferred embodiment the shoe is a men's dress shoe with a removable sole that can be replaced with a sole having "soft spike" golf cleats, to convert the shoe from a standard dress shoe to a golf shoe. Other embodiments of the invention include a casual shoe that converts to a golf shoe, a sport style "tennis" shoe that converts to a golf shoe, and a sports style shoe with interchangeable cleats for different sports such as soccer or baseball. These shoes can also be available in women and children's versions and styles.

The convertible shoe consists of a upper that holds the wearer's foot, and an interchangeable outsole that can have different treads or bottom surfaces that contact the ground. The underside of the upper has an attachment surface that mates with an attachment surface on the outsole to removably attach different outsoles. This is achieved by a unique paired top and bottom attachment of the two components. There are two main features that make this unique. First, the entire surface is contoured, which means that it is not flat, is curves from between the heel portion and the toe portion, but also at the toe kick. This means that the attachment components, specifically the mated hook and loop material and the paired offset ridge and channel, are in three dimensions and not just two dimensions as when the attachment components are flat. This allows the attachment to withstand the three dimensional forces of walking. The paired ridge and channel allow the attachment to withstand front to back or side to side lateral forces, the mated hook and loop material allow the attachment to withstand direct pull forces pulling the two components apart, and the contoured profile of the attachment allows the attachment to successfully withstand peel forces.

Another unique component of the present invention is that, in one embodiment, there are two paired ridges and channels, a heel end attachment and a toe end attachment. The toe end attachment sits under the toe of the wearer's foot, and ends just behind where the ball of the foot sits in the shoe. This is the place where shoes are subject to the most bend, and consequently the place where most attachments come apart. By placing the paired ridge and channel just in front of this spot, there are fewer forces on that particular attachment. A number of the prior art references noted include multi-part attachments, but all have the front attachment run to roughly the middle of the arch of the foot. This is because this is approximately where the standard front part of a standard dress shoe runs to.

Another unique feature is the flex grooves on the attachment surfaces. The flex grooves are located between the front (or toe) and rear (or heel) ridge and channel. The flex grooves are just behind the ball of the wearer's foot. This is the spot on a shoe that is subject to the most bending as the wearer walks in the shoe. The flex grooves allow the shoe components to bend, which reduces the bending in other parts of the shoe and therefore minimize the forces on the front and rear paired ridges and channels.

One of the technical difficulties in creating a removable attachment for components of a shoe is that it has to be strong enough to withstand the dynamic forces on the shoe and keep the components securely attached, while at the same time also be detachable. The present invention accomplishes this by means of the attachment mechanism which consists of the paired and mated protruding ridge and recessed channel, and the attachment material. The perimeter ridge is on the underside of the upper component and the recessed channel is on the top side of the lower component. There is attachment material on both components. The attachment material holds the two components together, while the paired perimeter ridge and perimeter channel allow the attachment to withstand the forces on the shoe during walking and keep the components securely attached. The paired perimeter ridge and channel also protect the attachment material from dirt and other foreign objects when the components are attached, which will prevent the fouling of the attachment material and reduction of the attachment properties of the attachment material.

The combination of the paired ridge and channel and the contoured or three-dimensional attachment surfaces has proven so secure that in some cases is has been difficult to separate the components. This led to the creation of the additional element of a gripping surface on one of the components that allows the user to grip the component to pull them apart. In the preferred embodiment the gripping surface consists of a thumb recess in the rear of the outside perimeter of the upper. This allows the wearer to grip the rear of the outsole in one hand and the body of the upper in the other, and pull the two components apart.

DETAILED DESCRIPTION OF THE INVENTION

Detailed embodiments of the present invention are disclosed herein. It is to be understood, however, that the disclosed embodiments are merely exemplary of the invention and that the invention may be embodied in various and alternative forms. Therefore, specified structural and functional details disclosed herein are not to be interpreted as limitations, but merely as a basis for the claims and as a representative basis for teaching one skilled in the art to variously employ the present invention.

Figure 1:
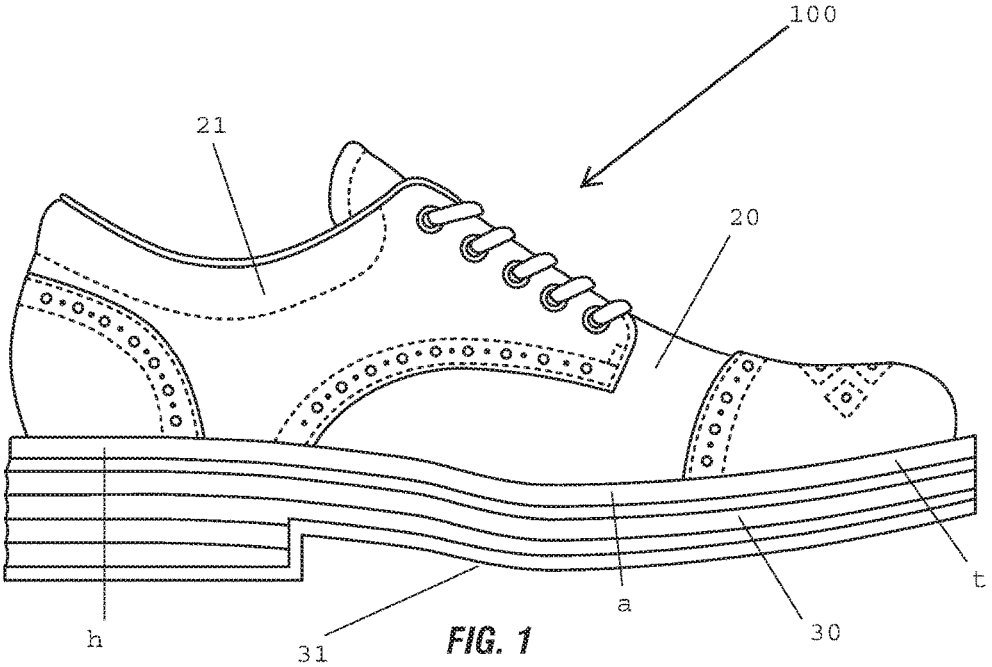
FIG. 1 is a side view of the invention with the outsole attached to the upper.
Figure 2:
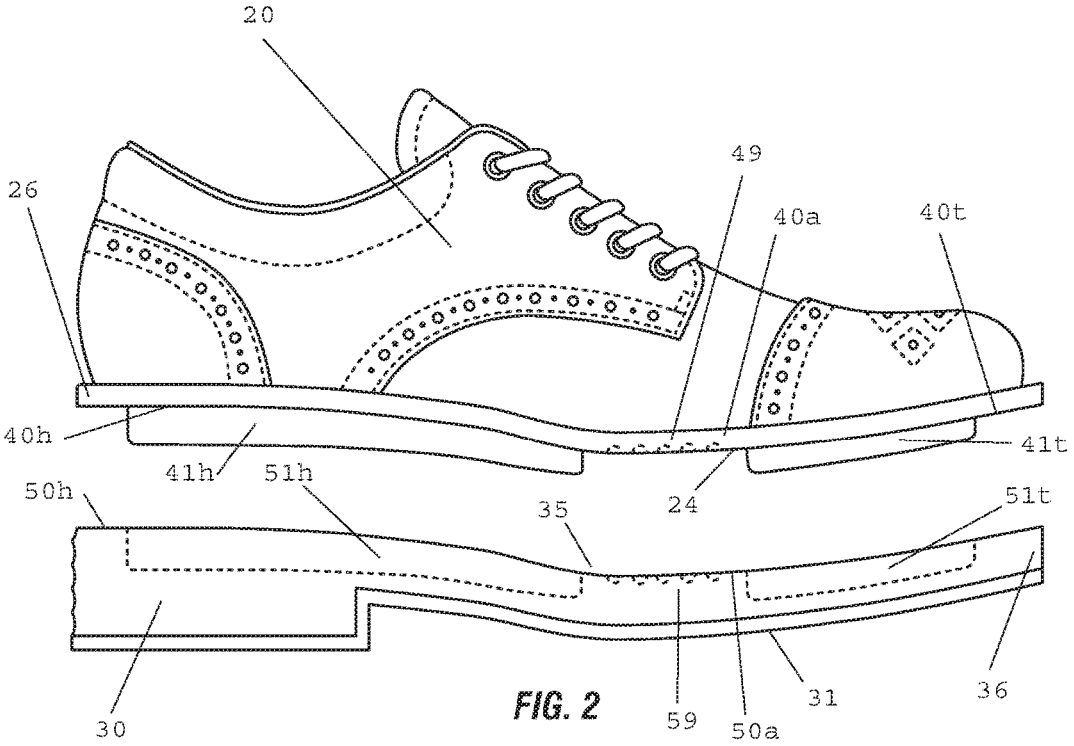
FIG. 2 is an exploded side view of the invention with the outsole separate from the upper.

FIG. 1 and FIG. 2 provide a general overview of the components of the convertible shoe 100. The convertible shoe 100 consists of an upper 20 and a detachable and attachable outsole 30. The upper 20 includes a housing 21 to hold a foot and an underside 24 having an underside attachment surface 40 and an underside outside perimeter 26. The outsole 30 includes a tread 31 which is the portion of the shoe that touches the ground, a topside 35 with a topside attachment surface 50, and a topside outside perimeter 36. The underside attachment surface 40 includes the underside attachment components described in detail below, and the topside attachment surface 50 includes the topside attachment components describe in detail below, wherein the topside attachments mate with and attach to the underside attachments to securely, yet removably, attach the outsole 30 to the upper 20. There are numerous outsoles 30 with differing treads 31 so that a single upper 20 can be converted into multiple different shoes for different purposes. The convertible shoe 100 shown in the figures is part of a pair of shoes and so all components are in both the left and right shoe.

Figure 3:
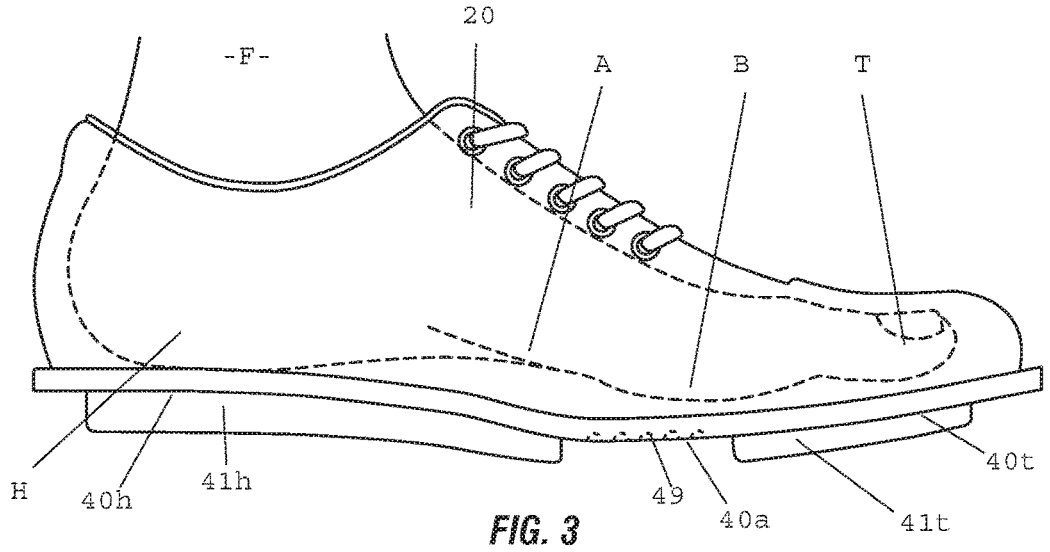
FIG. 3 is a side view of the upper with a foot inside the upper.

FIG. 1 is a side view of the convertible shoe 100 with the outsole 30 attached to the upper 20. The shoe depicted in FIG. 1 is a men's wingtip style shoe, but the shoe can be in any style, and can be men's, women's and children's shoes. FIG. 2 is an exploded side view showing the outsole 30 detached from the upper 20 and in position to be attached to the upper 20. FIG. 2 highlights a unique feature of the attachment components of the convertible shoe 100. As seen in FIG. 2, and particularly in FIG. 3 which shows the foot F inside the upper 20, the underside attachment surface 40 is curved, or contoured, and follows the natural curvature of the bottom of the human foot F. The heel of most shoes, even sports shoes with flat treads, is raised slightly above the level of the toe portion of the shoe. The heel portion h of the convertible shoe 100 is also raised slightly above the toe portion t. As seen in FIG. 2 and FIG. 3, the heel portion **40*h* of the underside 40 is generally flat and when the shoe is assembled and on a horizontal surface or the ground, and is roughly horizontal or parallel with the ground. The heel portion 40*h* blends seamlessly into the arch portion 40*a* of the underside 40. The arch A of the human foot F is curved (or arched, hence the name), and the arch portion 40*a* of the upper is slightly curved, and curves downward, to conform to the curve of the foot. The arch portion 40*a* blends seamlessly into the toe portion 40*t* at roughly the place behind the ball B of the foot within the shoe. The toe portion 40*t* is essentially flat, but curves upward slightly from the horizontal in what is known as the toe kick. The underside attachment surface 40 is one continuous piece but blends seamlessly from the heel portion 40*h* to the arch portion 40*a* to the toe portion 40*t*. The lowercase letter "t" when used in conjunction with element numbering will be used throughout to denote the toe portion of the shoe or its various components. Likewise "h" will denote heel portion, and "a" will denote arch portion. The topside attachment surface 50 of the outsole 30 is configured to mate with the underside attachment surface 40 and therefore follows the exact same contour as the underside attachment surface 40 of the upper 20, with the heel portion 50*h* roughly flat and horizontal, the arch portion 50*a* curved and angled downward, and the toe portion 50*t*** roughly flat with a slight upward kick.

There are a variety of pressures and forces on a shoe when the person wearing the shoe is walking. If the shoe is considered on the X-Y-Z axis, where the shoe runs from front to back on the X axis, top to bottom on the Y axis, and side to side on the Z axis, the forces occur in all three dimensions. The forces are both static and dynamic, and constantly changing as the wearer walks and moves in the shoe. There are obviously vertical, or up and down, forces on the Y-axis, which are created by the wearer stepping onto the shoe and exerting downward pressure, as well as upward pressure when the wearer steps forward and pulls up on the upper. This is known in the shoe making industry as "peel forces" because these forces can cause the various layers of a shoe to peel apart. There are also dynamic forces as the wearer walks in the shoe. Many people step first onto their heel, which creates forward forces along the X-axis that slides the various layers of a shoe against each other. All people walk differently, and many twist their foot slightly while walking to create twisting forces. There are also lateral forces on both the X and Z axis where the components of the shoe slide on each other. Many people also have a slight twisting motion from the ball of the foot to the toes as they step off of their trailing foot as they step forward. This causes torque forces on the X and Z axes, and near the front portion of the shoe. These various forces are known as shear forces. The combination of the shear and peel forces, and the fact that these are dynamic forces, makes it difficult to keep separate components of a shoe attached.

The geometry of the paired underside 40 and topside 50 attachment components allows the attached components to withstand all of these forces, and allows the outsole 30 to stay securely attached to the upper 20, until the wearer decides to separate the components and replace one style tread with another. One of the main places that a shoe flexes during walking is in the area just behind the ball B of the foot. This is because most people roll onto their toes as they step forward. This causes the shoe to bend the most just behind the ball B of the foot. The front part of the shoe, at and under the toes T, bends a little, but in many cases the slight curve of the toe kick allows the shoe to simply roll without bending. The heel portion h of the shoe is also not subject to significant bending forces, in part because the heel H of the foot F comes up in the opening of the housing 21 of the upper 20. As seen in FIG. 3, the flex grooves 49 on the upper and flex grooves 59 on the outsole 30 respectively, allowing the two components to bend easily at the point just under and behind the ball B of the foot. The flex grooves 49 and 59 are cut into the material of the upper 20 and outsole 30 which allow the upper 20 and outsole 30 to both easily contract and expand, allowing both the upper 20 and outsole 30 to easily flex or bend in both directions, and to create a flex area on the upper and outsole. This helps minimize the bending forces on the front of the shoe at the toe end t, and at the rear of the shoe at the heel end h. This minimizes the dynamic forces on the attachment bond at the toe end between the paired ridge and channel and attachment material. This helps ensure the attachment between the underside attachment surface 40 and topside attachment surface 50 remains attached during walking.

Another unique feature is the contoured shape of the attachment between the upper 20 and the outsole 30. Since both the underside attachment surface 40 and topside attachment surface 50 are contoured to follow the curvature of the human foot, the attachment between the underside attachment surface 40 and top side attachment surface 50 is also contoured, and therefore when they are attached the mated attachment is non-planar, or not flat. It angles from the rear to the front or from the heel end h to the toe end t, and therefore can more easily withstand the planar sheer forces on the shoe. Specifically the heel end protruding ridge 41*h* runs from the flat portion of the heel end 40*h* through part but not all of the curved part of the arch portion 40*a*. Similarly the heel end recessed channel 51*h* runs along the flat portion of the heel end 50*h* through part but not all of the arch portion 50*a*. This is best seen in the side view of FIG. 2. This means that both the heel end protruding ridge 41*h* and the heel end recessed channel 51*h* are on contoured, non-planar surfaces.

The paired attachment material 42 (42*t* & 42*h*) and 52 (52*t* & 52*h*) prevents the components from coming apart due to up and down or "peel" forces on the Y-axis. The placement of the protruding ridge 41 (41*t* & 41*h*) within the recessed channel 51 (51*t* & 51*h*) when the components are mated, is designed to account for all of the other shear forces and the X-axis & Z-axis. Since the paired ridge 41 and channel 51 runs just inside the perimeter of the components, it can withstand lateral and twisting forces, and thus ensure the components of the shoe can stay together. As noted, the contoured, or three dimensional non-uniform configuration allows the paired ridge 41 (41*t* & 41*h*) and channel 51 (51*t* & 51*h*) to account for all of the various three dimensional and non-vertical shear forces that are present on the shoe 100.

Figure 4:
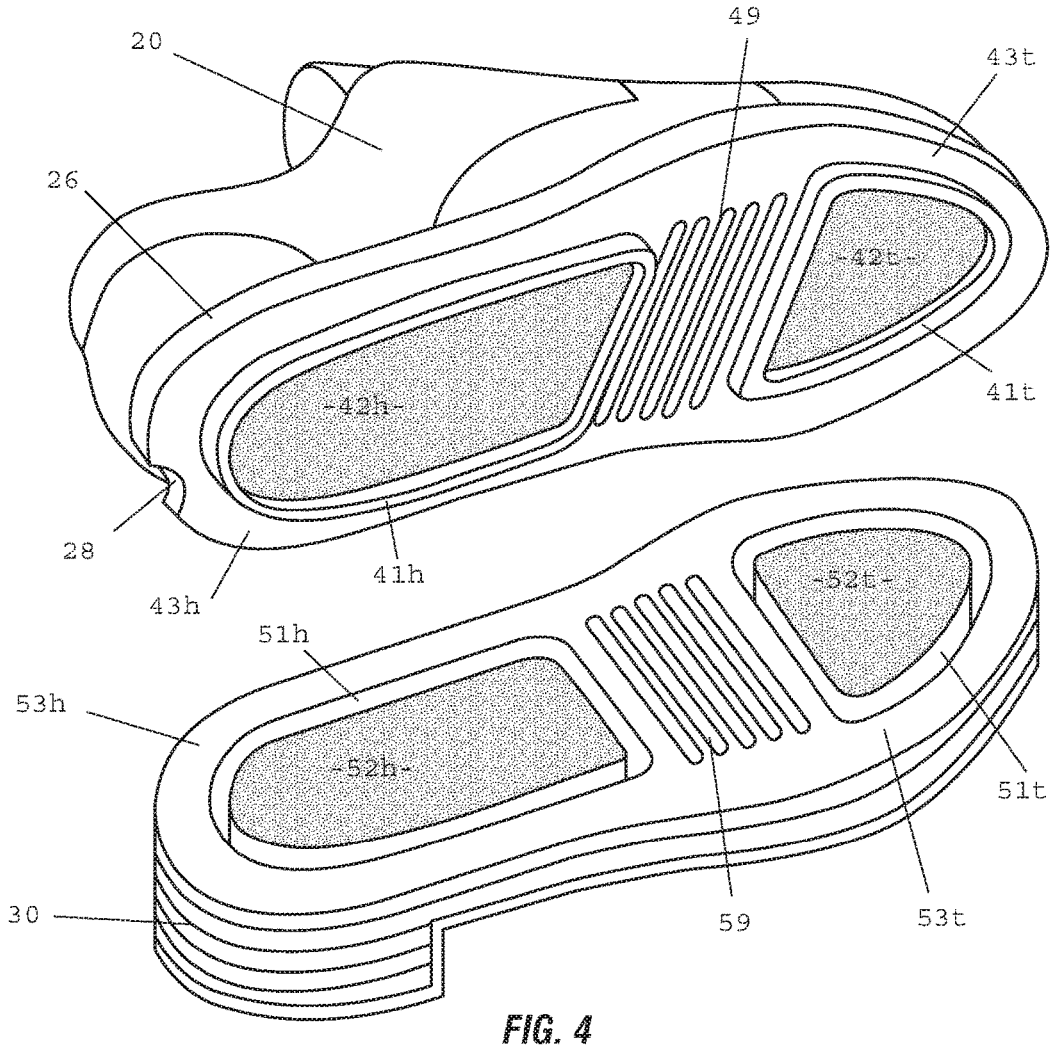
FIG. 4 is an exploded perspective view showing the attachment components of the underside of the upper and the topside of the outsole.

FIG. 4 shows the attachment components of the underside attachment surface 40 and the paired topside attachment surface 50. The attachment components are mirror images of each other and designed to mate with (i.e. fit into) each other. When the underside attachment surface 40 is mated with the topside attachment surface 50 the two surfaces are flush and joined together so that there are no spaces or gaps between the surfaces at any point. In the preferred embodiment the underside attachment surface 40 includes a toe end protruding ridge 41*t*, a heel end protruding ridge 41*h*, a toe end attachment material 42*t* which is disposed in the area defined by the toe end protruding ridge 41*t*, a heel end attachment material 42*h* which is disposed in the area defined by the heel end protruding ridge 41*h*, an upper lip 43, and flex grooves 49 which are located between the toe end protruding ridge 41*t* and the heel end protruding ridge 41*h*. In the preferred embodiment the topside attachment surface 50 includes a toe end recessed channel 51*t*, a heel end recessed channel 51*h*, a toe end attachment material 52*t* which is disposed in the area defined by the toe end recessed channel 51*t*, a heel end attachment material 52*h* which is disposed in the area defined by the heel end recessed channel 51*h*, a lower lip 53, and flex grooves 59 which are located between the toe end recessed channel 51*t* and the heel end recessed channel 51*h*.

The upper lip 43 runs around the entire perimeter 26 of the underside attachment surface 40, and in the area between the toe end protruding ridge 41*t* and the perimeter 26 it is the toe end upper lip 43*t*, in the area between the flex grooves 49 and the perimeter it is the arch area upper lip 43*a*, and in the area between the heel end protruding ridge 41*h* and the perimeter 26 it is the heel end upper lip 43*h*. The lower lip 53 runs around the entire perimeter 36 of the topside attachment surface 50. In the area between the toe end recessed channel 51*t* and the perimeter 36 it is the toe end lower lip 53*t*, in the area between the flex grooves 59 and the perimeter 36 it is the arch area lower lip 53*a*, and in the area between the heel end recessed channel 51*h* and the perimeter 36 it is the heel end lower lip 53*h*. When the upper 20 is attached to the outsole 30 the upper lip 43 presses against the lower lip 53 to create a seal, and so that the upper outside perimeter 26 and outsole outside perimeter 36 create a flush seal between the upper and outsole, and a uniform outside perimeter around the convertible shoe 100.

As seen in FIG. 3, the toe end protruding ridge 41*t* sits roughly under the toe T of the wearer of the shoe, running from roughly the position of the ball B of the foot to near the front of the shoe, but offset by the upper lip 43*t*. The toe end protruding ridge 41*t* is offset from the perimeter 26 a roughly uniform distance and defines the toe end upper lip 43*t*. The toe end protruding ridge 41*t* follows the curve of the toe end of the shoe and forms an arced triangle with rounded edges, with the bottom portion running roughly straight and widthwise across the width of the shoe. The heel end protruding ridge 41*h* sits roughly under the heel H of the wearer's foot, but runs towards the front of the shoe to roughly the end of the arch portion 40*a* of the underside surface 40. The portion of the heel end protruding ridge 41*h* at the back end of the shoe is curved downward to follow the curve of the heel end of the upper 20, then runs roughly straight though parallel with the perimeter of the heel portion of the shoe, then curves to a straight portion across the width of the upper 20 under roughly the arch portion a of the upper 20. When seen in the side view of FIG. 2, the heel end protruding ridge 41*h* is flat under the heel portion 40*h*, then curves downwardly at about a ten degree angle as it follows the contour of the underside attachment surface 40 along the arch portion 40*a*. As noted, the toe end recessed channel 51*t* attaches to and therefore follows the same geometry as the toe end protruding ridge 41*t*. And the heel end recessed channel 51*h* similarly attaches to and therefore follows the same geometry as the heel end protruding ridge 41*h*.

Disposed within the area defined within the two end protruding ridge 41*t* is toe end attachment material 41*t*, the heel end protruding ridge 41*h* is heel end attachment material 42*h*, the toe end recessed channel 51*t* is toe end attachment material 52*t*, and the heel end recessed channel 51*h* is heel end attachment material 52*h*. In the preferred embodiment the attachment material is hook and loop material commonly referred to with the trade name Velcro®. If hook and loop material is used, then one side will use hook material and the other will use loop material. In the preferred embodiment the attachment material 42*t* & 42*h* on the underside 24 of the upper 20 will be hook material, and the attachment material 52*t* & 52*h* on the top side 35 of the outsole 30 will be loop material. In an alternate embodiment the attachment material 42 and 52 is "Mushroom Velcro" such as that sold under the brand name 3-M™ Dual Lock™ fastener. This material is known as mushroom Velcro® because its cross section resembles a mushroom with a head protruding from a stem, and is also known as head and stem material. When two corresponding sheets of mushroom Velcro® are pressed together the heads snap into the space created by the stems to produce a very secure fit. The attachment material 42 and 52 is adhered to the attachment surface 40 and 50 by gluing or other conventional and well known means.

In one embodiment there are a series of parallel flex grooves 49 that run perpendicular to the width of the shoe and between the toe end protruding ridge 41*t* and the heel end protruding ridge 41*h*. The flex grooves 49 are grooves cut into the underside attachment surface 40, and are approximately 0.4 mm wide and 0.4 mm deep, but the precise dimensions can vary depending upon the size and style of the shoe. There are also a series of flex grooves 59 in the same position on the top side attachment surface 50 of the outsole 30. The flex grooves 49 and 59 are located at the front of the arch section 40*a* of the upper 20 and just behind the ball B of the wearer's foot, as shown in FIG. 3, and are in the same position on the outsole 30. This is the part of the shoe that is subject to the most bending forces, and the flex grooves 49 & 59 create a flew area that allow the shoe components (the upper 20 and the outsole 30) to easily flex. In the preferred embodiment as shown in FIG. 4, there are five flex grooves 49 and 59, but there can be more or less depending upon factors such as the size and style of the shoe (a women's or child's sized shoe may have fewer flex grooves), the material of the components, and the width of the grooves themselves. In some smaller sizes of shoes, particularly a child's size shoe, there may be no flex grooves.

Figure 5:
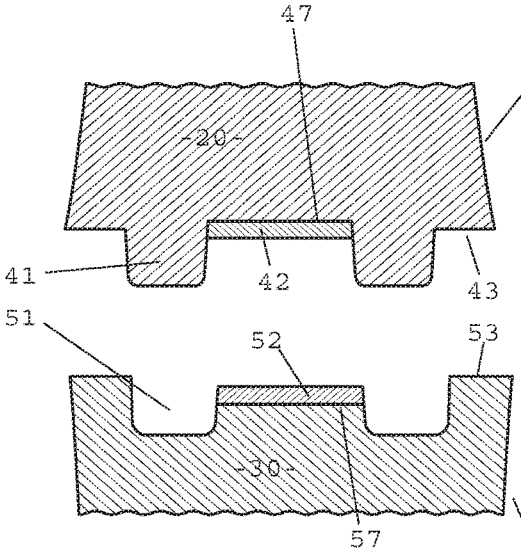
FIG. 5 is an exploded cut away cross section view showing the mated protruding ridge and recessed channel and attachment material of the upper and outsole in the unattached position.
Figure 6:
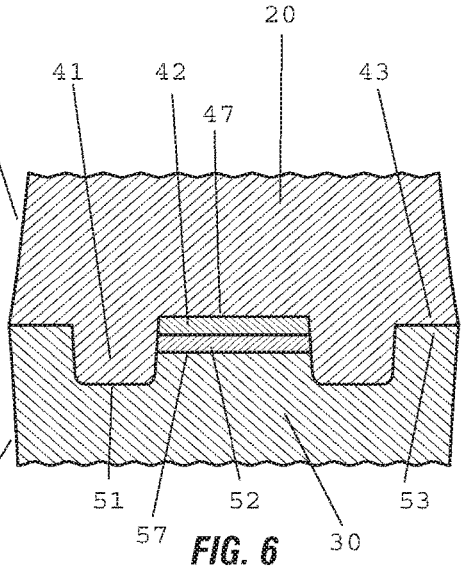
FIG. 6 is a cut away cross section view showing the components attached and the protruding ridge inserted into the recessed channel.

The upper 20 attaches to the outsole 30 as suggested by the exploded view of FIG. 2 and FIG. 4. FIG. 5 and FIG. 6 are cut away cross sectional views of the attachment components and show how they attach, with FIG. 5 separate and in position to be attached, and FIG. 6 attached. The recessed channels 51*t* & 51*h* (collectively 51 as shown in FIGS. 5 & 6) is the mirror image of, and has the same geometry as the protruding ridges 41*t* & 41*h* (collectively 41 as shown in FIGS. 5 & 6.) The two protruding ridges 41*t* and 41*h* have the same cross section geometry, and extend perpendicularly outward from the underside attachment surface 40. In the geometry that the shoe will be worn in this means that the protruding ridge 41 extends perpendicularly downwardly from the underside attachment surface 40. The protruding ridge 41 has a substantially rectangular cross section, with each side at nearly a 90 degree angle to the other, and are approximately ¼ (one quarter) of an inch wide and approximately ¼ (one quarter) of an inch thick, but this size can vary slightly depending upon the size and style of the shoe. In the preferred embodiment the protruding ridge 41 is 5.0 mm wide and 5.0 mm high. In other embodiments, the geometry of the ridge 41 and channel 51 can vary. For example it may be smaller in a women's or child's shoe than in a man's shoe. The recessed channel 51 has a substantially rectangular cross section, with each side at nearly a 90 degree angle to the other, and is approximately ¼ (one quarter) of an inch wide and approximately ¼ (one quarter) of an inch deep, but this size can vary slightly, but will always be equivalent to the paired protruding ridge 41 so that the ridge 41 fits tightly into the channel 51. In the preferred embodiment the recessed channel 51 is 5.0 mm wide and 5.0 mm deep. In other embodiments, the geometry of the ridge 41 and channel 51 can vary. For example it may be smaller in a women's or child's shoe than in a man's shoe.

FIG. 5 shows the ridge 41 and channel 51 separate and in position to be joined, and FIG. 6 shows the ridge 41 inserted perpendicularly into the channel 51. The protruding ridge 41 is offset a uniform distance from the underside outside perimeter 26 to create the upper lip 43, and in most embodiments the ridge is offset approximately 6.0 to 8.0 mm, although the uniform offset can vary depending upon the size of the shoe. FIG. 6 also shows how the upper lip 43 and lower lip 53 touch to create a seal around the outside perimeter of the shoe 100 when the outsole 30 is attached to the upper 20. As can also best be seen in FIG. 6 the components are uniform so that the two outside perimeters 26 and 36 are flush to that there is a uniform outside surface on the perimeter of the convertible shoe 100. This means that the seam created between the upper 20 and outsole 30 is not readily visible when the two components are attached.

When the outsole 30 is attached to the upper 20, the toe end protruding ridge 41*t* fits into the toe end recessed channel 51*t*, and the heel end protruding ridge 41*h* fits into the heel end recessed channel 51*h*, as shown in the cross-sectional views of FIG. 5 and FIG. 6. Modern molding techniques allow for very precise molds so that the protruding ridge 41 can be almost precisely sized and configured to fit within the recessed channel 51. When molded properly the ridge 41 and channel 51 can snap together to create a relatively secure attachment. When the protruding ridge 41 is inserted into the recessed channel 51, the top attachment material 42 will engage the bottom attachment material 52 to secure the two components together.

When the outsole 30 is attached to the upper 20, the toe end attachment material 42*t* mates with the toe end attachment material 52*t*, and the heel end attachment material 42*h* mates with the heel end attachment material 42*h*. Since the attachment material on the upper is the same at the toe end and the heel end this is denoted in FIG. 5 & FIG. 6 as 42, and since the attachment material on the outsole is the same it is denoted as 52. The upper attachment material 42 is attached to the upper underside attachment surface 47, and the outsole attachment material 52 is attached to the outsole topside attachment surface 57. As can be seen in FIG. 5 and FIG. 6, the upper underside attachment surface 47 is slightly lower than the upper lip 43, and the outsole topside attachment surface 57 is slightly lower than the lower lip 53. This is necessary to account for the thickness of the upper attachment material 42 and outsole attachment material 52. When the attachment material 42 and 52 is attached to the attachment surfaces 47 and 57 they create a thickness so that when the two attachment materials 42 and 52 mate the components align, and the upper lip 43 and lower lip 53 create a seamless lip around the outside perimeter of the shoe.

When the upper 20 is attached to the outsole 30 the upper lip 43 will sit directly on the lower lip 53 to create a seam around the perimeters 26 and 36 of the shoe. Because of modern molding techniques the seam will be very tight and will protect the attachment components of the shoe. Additionally, the mated protruding ridge 41 and recessed channel 51 will provide additional protection for the attachment material 42 and 52 from dirt and other extraneous material that is encountered during wear. When dirt and other material gets into the hook and loop material is can reduce the ability of the securely hold. Such fouling of the attachment material 42 and 52 can reduce the ability of the material to hold the components together. The mated ridge 41 and channel 51 protects the attachment material 42 and 52 and ensures that it retains its attachment strength throughout the life of the convertible shoe 100.

In the preferred embodiment the main part of the attachment components, the underside attachment 40 and top side attachment 50 are made of injection molded plastic in a process well known in the art. The components can be made from a variety of molded plastic materials, including, but not limited to EVA plastic, PE plastics, PU plastic, or any other molded plastic materials well known in the art.

The shoe upper 20 can be any number of common styles and variations. The upper will most commonly be an enclosed style shoe, but it is possible to be a sandal or open back style shoe. The upper 20 can be made of any common material for making shoe uppers including cloth and leather, as well as a variety of other natural or synthetic materials.

Figure 7:
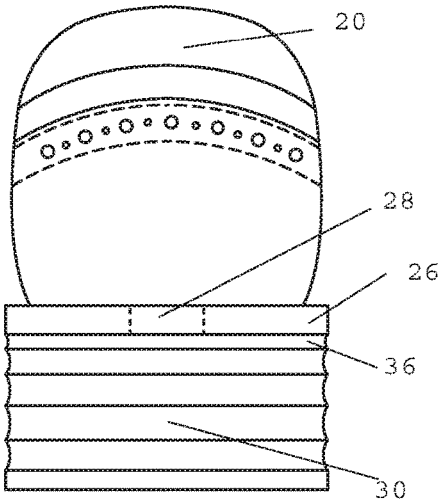
FIG. 7 is a rear plan view of the invention with the outsole attached to the upper.
Figure 8:
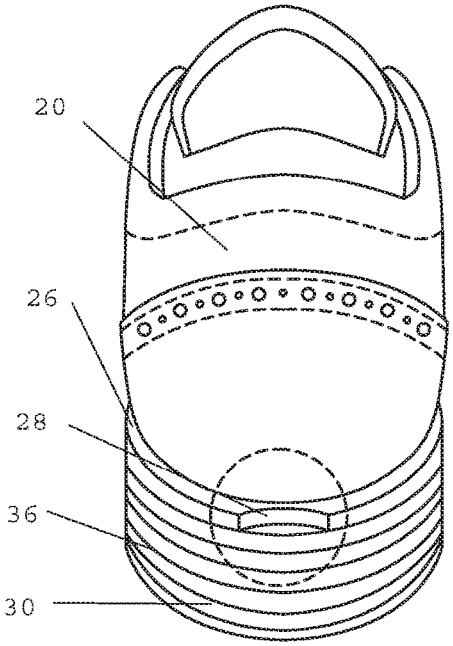
FIG. 8 is a rear perspective view of the heel portion of the invention showing the grip indent.
Figure 9:
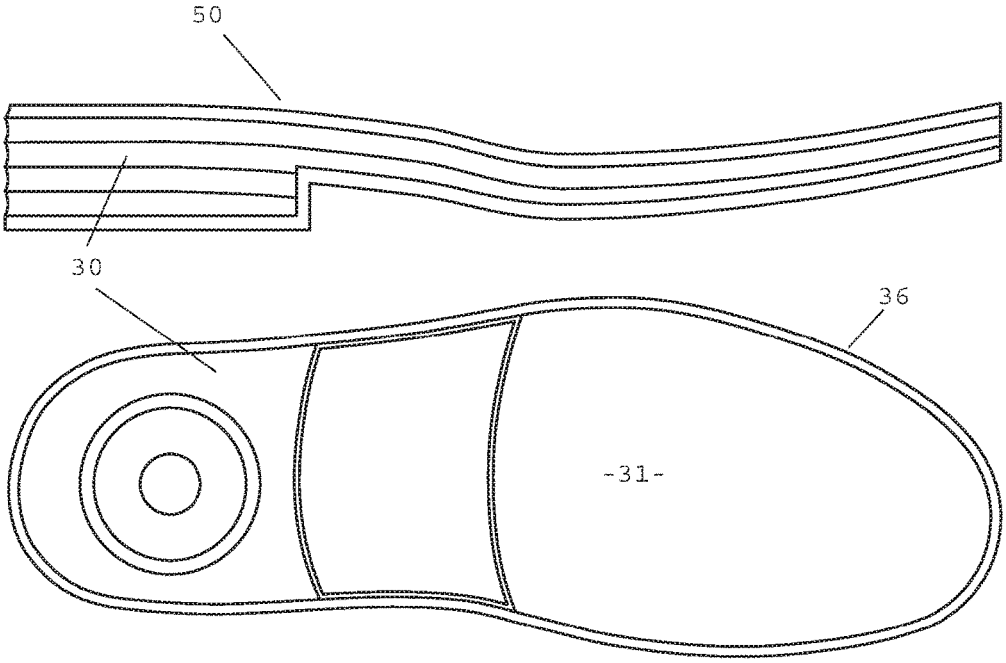
FIG. 9 shows a side view of a casual style interchangeable outsole above the underside view of the tread of the casual style interchangeable outsole.
Figure 10:
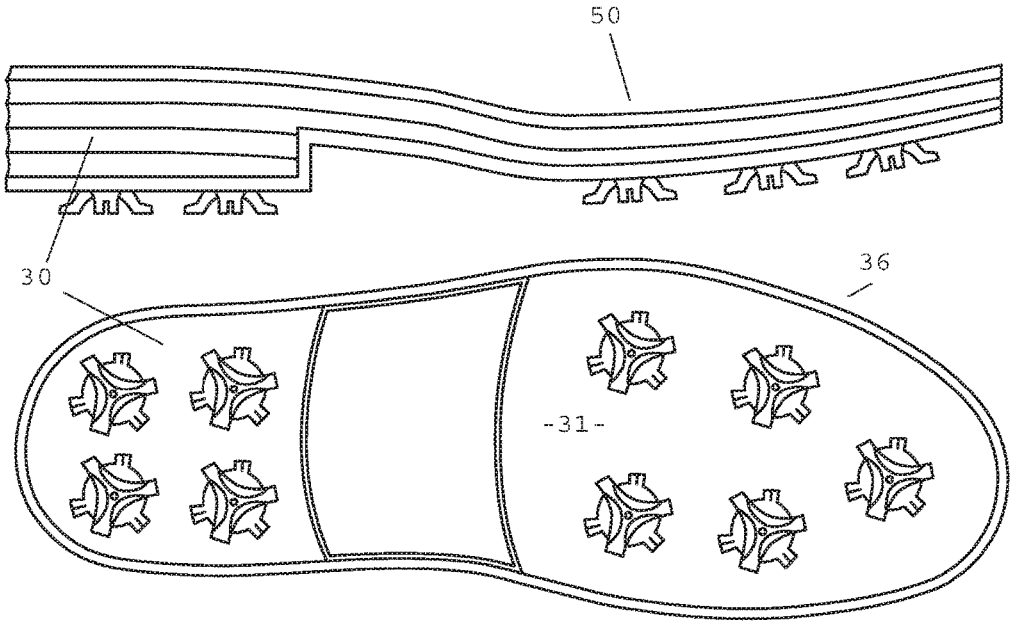
FIG. 10 shows a side view of a golf shoe style interchangeable outsole above the underside view of the golf shoe style interchangeable outsole tread with soft spikes.

The attachment means described above are designed to hold the outsole 30 securely to the upper 20 to deal with the dynamic forces of walking. The combination of the protruding ridges 41*t* and 41*h* mating with the recessed channels 51*t* and 51*h*, and the attachment materials 42*t* and 42*h* mating with the attachment materials 52*t* and 52*h* are able to withstand all of the three dimensional forces in the X, Y, and Z axes on the convertible shoe 100. In the current design the combination of the paired attachment material 42 and 52, the curved and non-planar attachment surfaces 40 and 50, and the paired protruding ridges 41*t* & 41*h* and recessed channels 51*t* & 51*h*, has proven to have sufficient holding strength to hold the components together during walking. Unfortunately the strength of the bond created makes it difficult to separate the components so additional design features have been added to make it easier to separate the components. FIG. 7 and FIG. 8 show the rear, or heel end, of the shoe. There is a semi-circular grip indent 28 which is cut into the outside perimeter 26 of the upper. The grip indent is approximately one inch wide and roughly a quarter of an inch deep into the perimeter 26. This exposes a small section of the lower lip 53*h* at the heel end. This provides a gripping area on the outsole 30. The user can hold the upper 20 at the inside of the heel portion, and grab the outsole 30 using the thumb in the grip indent, and can then begin to pull the outsole 30 off of the upper 20.

In one embodiment the heel portion of the outsole 30*h* has a series of wave shaped ridges on the outsole perimeter 36, which is seen in FIG. 1 and in FIG. 7. The wave shaped ridges provide a gripping surface so that the user can easily grab the heel of the outsole while holding the upper inside the heel end, which allows the user to pull the two components apart. In alternate embodiments there are no ridges on the surface of the outsole perimeter 36, but are other gripping features to provide a gripping surface to allow the user to firmly grasp the heel. In one possible variation this consists of small raised Braille-like dots to create texture on the surface. In another possible variation this consists of small slits cut into the surface of the perimeter to provide texture for a gripping surface.

Figure 11:
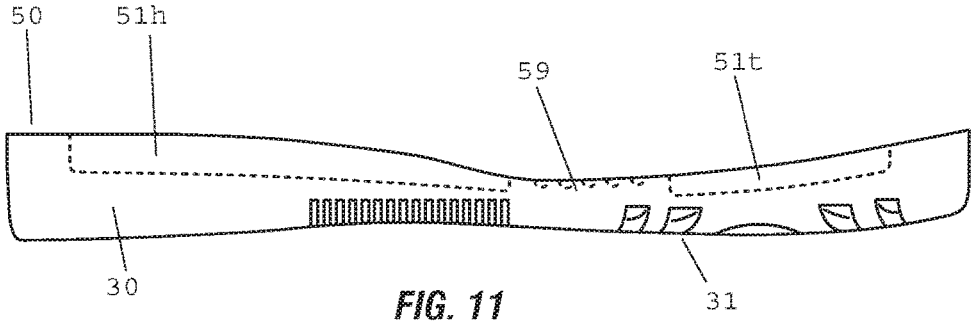
FIG. 11 is the side view of an athletic style outsole.
Figure 12:
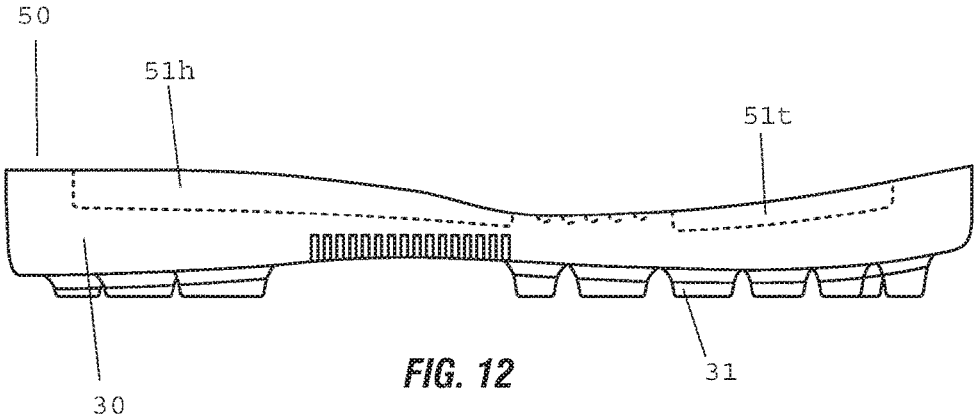
FIG. 12 is the side view of an athletic style outsole with cleats.
Figure 13:
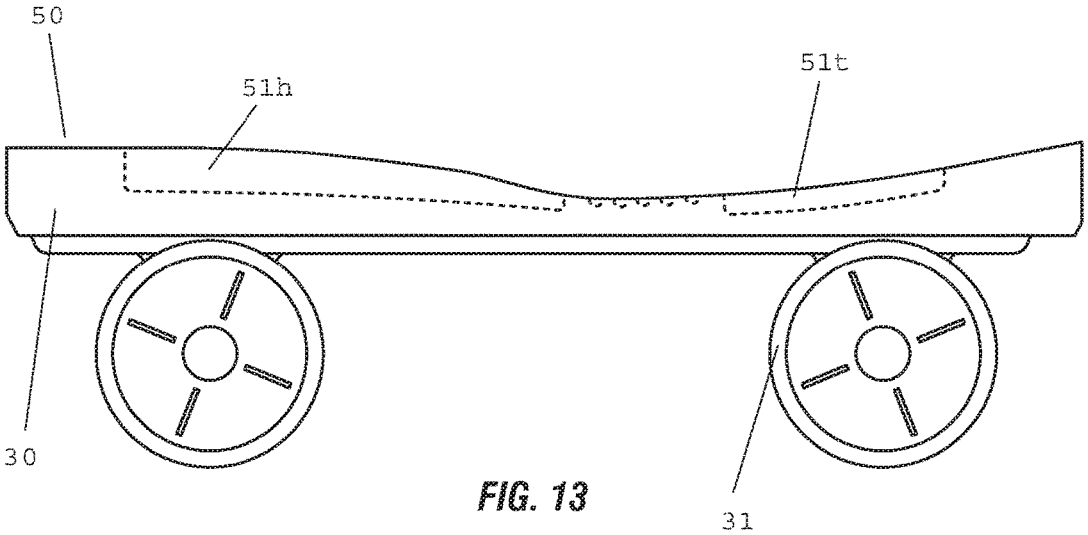
FIG. 13 is the side view of an outsole configured with wheels to create a roller skate.

The main purpose of the convertible shoe with interchangeable sole is to allow the user to convert the shoe from one configuration to another. The most preferred embodiment allows the user to convert from a dress style shoe to a golf shoe. FIG. 1 shows the side view of a wingtip style shoe. FIG. 7 shows the outsole 30 of a dress or casual style sole with a rubberized crepe tread 31. FIG. 8 shows an outsole 30 configured with soft spikes for golf. The user can easily convert the shoe from a dress shoe to a golf shoe by removing the dress style outsole 30 of FIG. 7, and attaching the golf style outsole of FIG. 8. It is conceivable, and within the conception of the invention, to switch between a wide variety of outsoles. The upper, for example, could be a more casual style shoe, or even an athletic style shoe, and the outsole 30 can be switched between different types and styles of spikes or cleats. The athletic style outsole of this configuration is seen in FIG. 11, and a representative outsole with cleats or spikes is shown in FIG. 12. It is even possible to attach wheels to the outsole 30 to allow the shoe to be converted into a roller skate, as shown in FIG. 13.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

I claim:

1. A shoe with an interchangeable sole comprising:

an upper having a housing that is configured to hold a wearer's foot and that has a contoured underside attachment surface;

an outsole having a tread and a contoured topside attachment surface;

wherein said contoured underside attachment surface has a heel portion configured to be located under a heel of the wearer's foot, an arch portion configured to be located under an arch of the wearer's foot, and a toe portion configured to be located under a toe of the wearer's foot, and wherein further said contoured underside attachment surface is configured to follow the contour of the foot within the upper such that said heel portion is substantially flat, said arch portion is curved downwardly, and said toe portion curves to substantially flat from said arch portion to a slight upward toe kick;

wherein said contoured topside attachment surface has a topside heel portion that matches said underside heel portion, a topside arch portion that matches said underside arch portion, and a topside toe portion that matches said underside toe portion such that the topside attachment surface mates with the underside attachment surface;

wherein said contoured underside attachment surface includes a contiguous toe end protruding ridge located on said toe portion, wherein said contiguous toe end protruding ridge runs widthwise across the underside attachment surface configured to be behind the toes of the wearer's foot and then follows and is offset a uniform distance from a toe end outside perimeter and thereby defines an underside toe end attachment field therein, and a contiguous heel end protruding ridge located on said heel portion, wherein said contiguous heel end protruding ridge runs widthwise across the underside attachment surface below the arch and then follows and is offset a uniform distance from a heel end outside perimeter and thereby defines an underside heel end attachment field therein;

said topside attachment surface includes a contiguous toe end recessed channel located on said toe portion, wherein said contiguous toe end recessed channel runs widthwise across the underside attachment surface behind the toes of the foot and then follows and is offset a uniform distance from a toe end outside perimeter, and thereby defines a topside toe end attachment field therein; and a heel end recessed channel located on said heel portion, wherein said contiguous heel end recessed channel runs widthwise across the underside attachment surface below the arch and then follows and is offset a uniform distance from a heel end outside perimeter, and thereby defines a topside heel end attachment field therein;

wherein said contiguous toe end protruding ridge fits into said contiguous toe end recessed channel and said contiguous heel end protruding ridge fits into said contiguous heel end recessed channel, and wherein said underside toe end attachment field mates with said topside toe end attachment field and said underside heel end attachment field mates with said topside toe end attachment field to create a secure yet detachable attachment between said upper and said outsole.

2. The shoe with an interchangeable sole of claim 1 wherein multiple outsoles having different treads have said contoured topside attachment surface thereby allowing said upper to attach to outsoles having different treads.

3. The shoe with an interchangeable sole of claim 1 wherein said heel end attachment field and said toe end attachment field of the underside is covered with a hook side of hook and loop attachment material, and said heel end attachment field and said toe end attachment field of the topside is covered with a loop side of hook and loop attachment material.

4. The shoe with an interchangeable sole of claim 1 wherein said heel end attachment field and said toe end attachment field of the underside is covered with head and stem attachment material, and said heel end attachment field and said toe end attachment field of the topside is covered with head and stem attachment material.

5. The shoe with an interchangeable sole of claim 1 further including:

a multiplicity of flex grooves located on said underside attachment surface between said toe end protruding ridge and said heel end protruding ridge that create a flex area on said upper, wherein said flex area minimizes the bending of the toe portion and heal portion of said underside attachment surface; and a multiplicity of flex grooves located on said topside attachment surface between said toe end recessed channel and said heel end recessed channel that create a flex area on said outsole wherein said flex area minimizes the bending of the toe portion and heal portion of said topside attachment surface;

wherein when said outsole is attached to said upper said flex areas minimize bending of the attachment between the toe end protruding ridge and underside toe end attachment field and toe end recessed channel and topside toe end attachment field, and minimize bending of the attachment between the heel end protruding ridge and underside heel end attachment field and heel end recessed channel and topside heel end attachment field, thereby ensuring a secure attachment between the upper and the outsole.

6. The shoe with an interchangeable sole of claim 5, wherein said flex grooves are located under a ball of the wearer's foot.

7. The shoe with an interchangeable sole of claim 1 wherein:

said underside attachment surface has an underside outside perimeter;

said topside attachment surface has a topside outside perimeter; and wherein when said underside attachment surface is attached to said topside attachment surface, said underside outside perimeter and said topside outside perimeter align seamlessly to create a uniform outside perimeter.

8. The shoe with an interchangeable sole of claim 7 wherein:

said toe end protruding ridge and heel end protruding ridge are offset a uniform distance from said underside outside perimeter to create an upper lip;

said toe end recessed channel and heel end recessed channel are offset a uniform distance from said topside outside perimeter to create a lower lip;

wherein when said underside attachment surface is attached to said topside attachment surface said upper lip touches said lower lip to form a seamless bond.

9. The shoe with an interchangeable sole of claim 1 wherein;

said heel end protruding ridge runs the length of the heel portion of the underside attachment surface and then partially the length of the arch portion such that said heel end protruding ridge follows the contour of the arch portion, thereby making both the heel end protruding ridge and underside heel end attachment field contoured said heel end recessed channel runs the length of the heel portion of the topside attachment surface and then partially the length of the arch portion such that said heel end recessed channel follows the contour of the arch portion, thereby making both the heel end recessed channel and topside heel end attachment field contoured.

10. The shoe with an interchangeable sole of claim 1 wherein said protruding ridges and paired recessed channels have rectangular cross sections.

11. The shoe with an interchangeable sole of claim 8 wherein said outsole further includes an outsole outside perimeter and wherein said outsole outside perimeter has a ribbed surface to provide a gripping area.

12. The shoe with an interchangeable sole of claim 8 wherein;

said outsole further includes an outsole outside perimeter;

said upper further includes an upper outside perimeter, and wherein there is a small semi-circular cut-out in a heel end of said upper outside perimeter which exposes a small semi-circular portion of said lower lip to allow the gripping of the lower lip to separate outsole from upper.

13. The shoe with an interchangeable sole of claim 8 wherein:

said underside toe end attachment field consists of attachment material disposed on an underside toe end attachment surface and said underside heel end attachment field consists of attachment material disposed on an underside heel end attachment surface;

said topside toe end attachment field consists of attachment material disposed on a topside toe end attachment surface and said topside heel end attachment field consists of attachment material disposed on a topside heel end attachment surface;

wherein said underside toe end attachment surface, said underside heel end attachment surface, said topside toe end attachment surface, and said topside heel and attachment surface are recessed to accommodate the thickness of the attachment material such that when said outsole is attached to said upper said attachment material mates, said protruding ridges mate with said recessed channels, and said upper lip mates with said lower lip to create a seamless bond.

* * * * *